US009011200B2

(12) United States Patent
Upton et al.

(10) Patent No.: US 9,011,200 B2
(45) **Date of Patent: *Apr. 21, 2015**

(54) BRA TOP

(71) Applicant: Crupton LLC, Laytonsville, MD (US)

(72) Inventors: Julie Upton, Laytonsville, MD (US); Brian Crotty, Laytonsville, MD (US)

(73) Assignee: Crupton LLC, Laytonsville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/046,362

(22) Filed: Oct. 4, 2013

(65) Prior Publication Data

US 2014/0038492 A1 Feb. 6, 2014

Related U.S. Application Data

(63) Continuation of application No. 12/913,194, filed on Oct. 27, 2010, now Pat. No. 8,550,872.

(60) Provisional application No. 61/256,848, filed on Oct. 30, 2009.

(51) Int. Cl.

| | |
|---|---|
| ***A41C 3/00*** | (2006.01) |
| ***A41C 3/12*** | (2006.01) |
| ***A41D 1/22*** | (2006.01) |

(52) U.S. Cl.

CPC ... *A41C 3/12* (2013.01); *A41C 3/00* (2013.01); *A41D 1/22* (2013.01)

(58) Field of Classification Search

CPC ..... A41C 3/00; A41C 3/0014; A41C 3/005; A41C 3/06

USPC ..... 450/64–69, 74–76

See application file for complete search history.

(56) References Cited

U.S. PATENT DOCUMENTS

| | | | |
|---|---|---|---|
| 4,583,544 | A | 4/1986 | Flanagan et al. |
| 5,479,791 | A | 1/1996 | Osborne |
| 5,553,468 | A | 9/1996 | Osborne |
| 5,592,836 | A | 1/1997 | Schuster et al. |
| 5,667,422 | A | 9/1997 | Erwin |
| 6,083,080 | A | 7/2000 | Lawson et al. |
| 6,125,664 | A | 10/2000 | Browder, Jr. |
| 6,572,437 | B1 | 6/2003 | Waitz |
| 6,622,312 | B2 | 9/2003 | Rabinowicz |
| 6,708,530 | B2 | 3/2004 | Mitchell |
| 6,779,367 | B2 | 8/2004 | Mitchell et al. |
| 7,051,557 | B2 | 5/2006 | Mitchell et al. |
| 7,409,728 | B2 | 8/2008 | Harry |
| 7,780,502 | B2 | 8/2010 | Calamari et al. |
| 8,062,093 | B2 | 11/2011 | DeSousa |
| 8,096,851 | B2 | 1/2012 | Fine |
| 8,152,591 | B2 | 4/2012 | DeSousa et al. |
| 8,182,310 | B2 | 5/2012 | Clair et al. |

(Continued)

*Primary Examiner* — Gloria Hale

(74) *Attorney, Agent, or Firm* — Akerman LLP

(57) ABSTRACT

A bra top that can be worn between a wearer's regular bra and their outer garment. The bra top is designed so that the wearer can choose to appropriately cover their cleavage when wearing a low-cut top. The bra top includes a front portion having a generally convex lower border, and a back portion attached to or integral with the front portion and having a generally concave lower border. The bra top is comprised of a material having 80% or more natural fibers and 20% or less stretchable synthetic fibers. The convex lower border of the front portion extends lower than the concave lower border of the back portion such that additional material is available to comfortably cover a wearer's breasts.

19 Claims, 3 Drawing Sheets

(56) References Cited

U.S. PATENT DOCUMENTS 8,221,186 B2 7/2012 Policaro et al.
8,241,088 B2 8/2012 Murphy et al.
8,257,139 B2 9/2012 De Sousa et al.
8,371,901 B2 2/2013 Frey
8,550,872 B2 * 10/2013 Upton et al. ..... 450/66

* cited by examiner

BRA TOP

CROSS-REFERENCE TO RELATED APPLICATIONS

This application is a continuation of U.S. patent application Ser. No. 12/913,194, filed Oct. 27, 2010, which claims priority from U.S. Patent Application No. 61/256,848, filed Oct. 30, 2009, the entirety of which are incorporated herein by reference.

BACKGROUND OF THE INVENTION

1. Field of the Invention

The present invention relates to a bra top designed to allow a woman to cover her cleavage when wearing low-cut tops.

2. Description of the Related Art

Various methods have been proposed to cover a woman's cleavage when she is wearing a low-cut top. One way of doing this is for the woman to wear a second garment, such as a camisole, underneath her outer garment. However, in hot weather, or when undertaking strenuous exercise, a second item of clothing can be uncomfortably warm for the wearer. Additionally, a second garment such as a camisole can bunch up or ride up underneath the outer garment. This can cause unsightly bulges and wrinkles in the outer garment, as well as being uncomfortable for the wearer. Another alternative is for the woman to wear a sports bra underneath her outer garment, but as sports bras are typically designed to restrict movement of the breasts, or to bind the breasts, this can be a deterrent to wearing sports bras for everyday activities. Sports bras may also not have cups of a sufficient thickness to prevent a woman's nipples from showing through her top, or may have obvious seams that a wearer may not wish to show, and so they may not be appropriate for all situations.

As a further alternative to wearing a full camisole or other top underneath the low-cut top, some partial garments are designed to be attached to the wearer's bra. For example, US Patent Application Publication No. 2007/0281585 to Calamari et al., U.S. Pat. No. 7,520,794 to Johnson, US Patent Application Publication No. 2009/0093189 to Frey, and U.S. Pat. No. 7,409,728 to Harry all relate to partial garments that can be attached to a wearer's bra to cover their cleavage. The partial garments suffer from various disadvantages, including that their attachment to a bra can be lumpy, and thus visible under clothes, that the edges of the partial garments can curl or wrinkle which, again, can become visible under clothes.

It is desirable to provide an alternative solution to women to enable them to cover their cleavage, if desired, while wearing a low cut top.

SUMMARY OF THE INVENTION

According to an arrangement of the present invention, a bra top that can be worn between a wearer's regular bra and their outer garment is disclosed. The bra top includes a front portion having a generally convex lower border, and a back portion attached to or integral with the front portion and having a generally concave lower border. The convex lower border of the front portion extends lower than the concave lower border of the back portion such that additional material is available in the front portion to comfortably cover a wearer's breasts such that the lower border of the front portion and the lower border of the back portion are generally level around a wearer's ribcage when the bra top is worn. The bra top is also comprised of a knit material having 80% or more natural fibers and 20% or less stretchable synthetic fibers or fiber blends such that the knit material has enough elasticity to stay in place when worn without constricting the wearer.

The bra top may be comprised of 85% or more natural fibers and 15% or less stretchable synthetic fibers or fiber blends. In other arrangements, the bra top may have 90% or more natural fibers and 10% or less stretchable synthetic fibers or fiber blends, for example, 90-95% natural fibers and 5-10% stretchable synthetic fibers or fiber blends.

The natural fibers can be selected from the group consisting of cotton, bamboo, silk, rayon, hemp, and linen. The synthetic fibers can be spandex.

In certain arrangements, the convex lower border of the front portion extends 1-3 inches lower than the concave lower border of the back portion at the point of maximum distance between the convex and concave lower borders. For example, the front portion may extend 1-2 inches lower than the back portion, and may in some arrangements be approximately 1.5 inches lower.

Notably, no cups, seams or darts are present in the body of the front portion. Furthermore, the lower borders of the front and back portions do not include elastic additional to the stretchable synthetic fibers present in the knit material.

The bra top allows the wearer to cover as much cleavage as she wants without having to wear two full garments, such as a full tank top or camisole and an outer top, that may wrinkle or bunch due to fabric interactions, and which may be too warm to wear together. The wearer does not need to continuously readjust a tank top or camisole to smooth out wrinkles or bunching under other garments. Also, there is no added material around the wearer's waist which might add bulk to the wearer's waist area.

BRIEF DESCRIPTION OF THE DRAWINGS

There are shown in the drawings arrangements which are presently discussed, it being understood, however, that the invention is not limited to the precise arrangements and instrumentalities shown, wherein.

DETAILED DESCRIPTION OF THE DRAWINGS

The present invention is directed to a bra top which is generally defined as, but not limited to, a half top, a sports bra-type top, a shortened camisole, a half tank top, or the like. The arrangements of bra tops described herein disclose tops that can be used to cover a wearer's cleavage, but this is a mere example of one of many possible applications for the invention.

Figure 1:
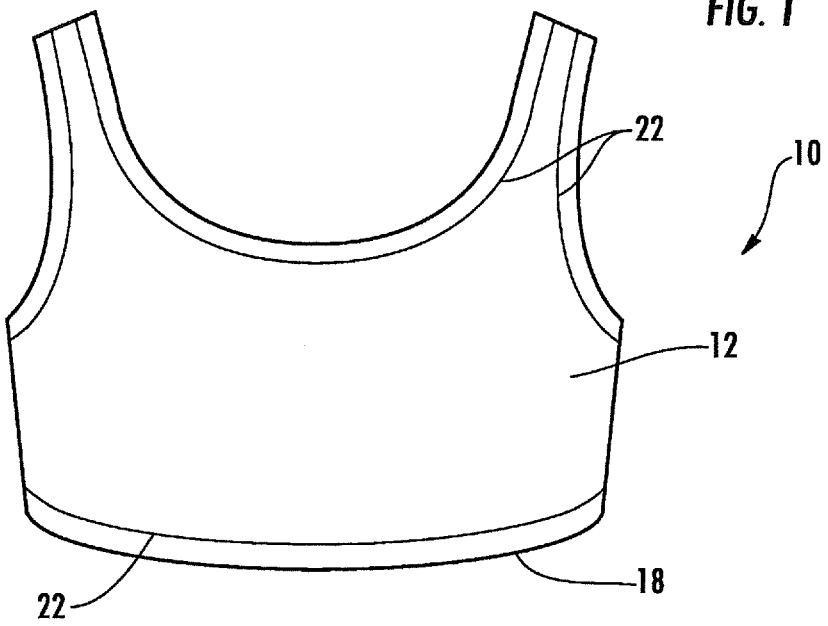
FIG. 1 is a front view of a bra top according to arrangements of the present invention.
Figure 2:
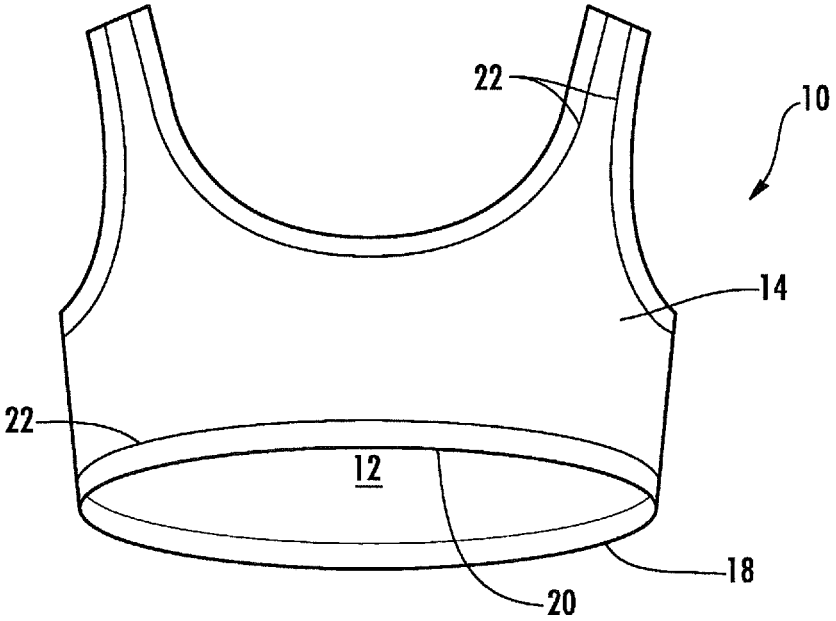
FIG. 2 is a back view of the bra top of FIG. 1.
Figure 3:
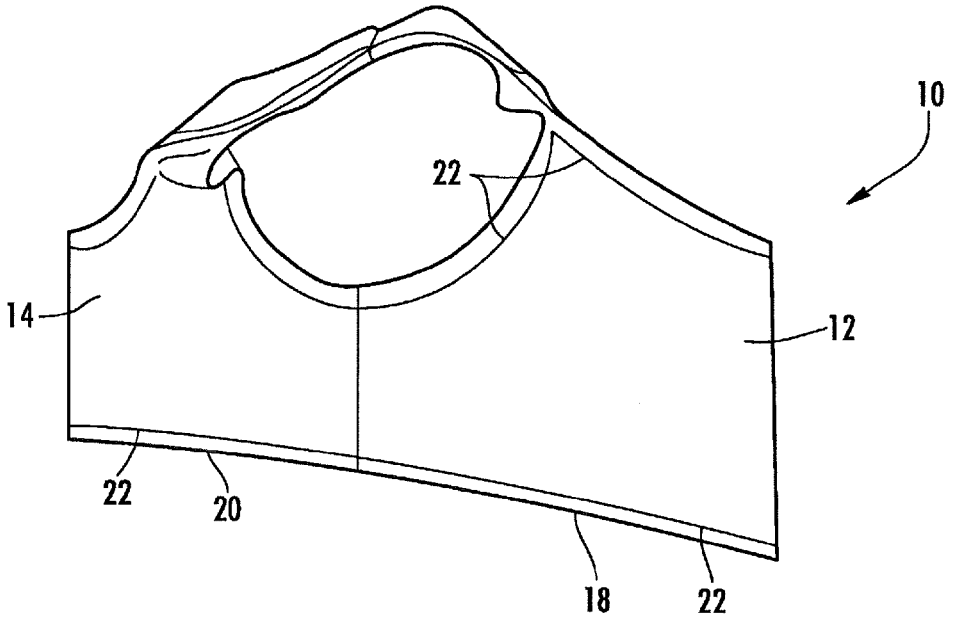
FIG. 3 is a side view of the bra top of FIG. 1.
Figure 4:
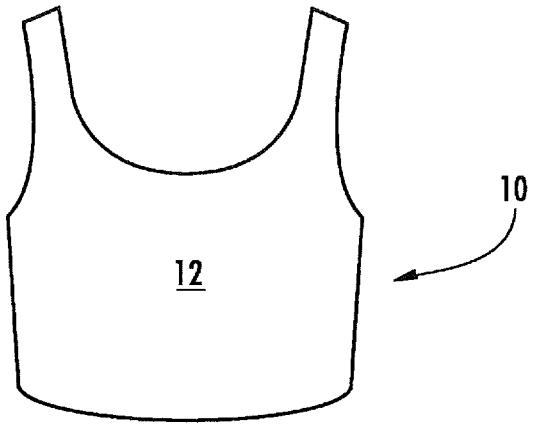
FIG. 4 is a front view of an alternative arrangement of bra top according to the present invention, showing a square neckline and thin straps.
Figure 5:
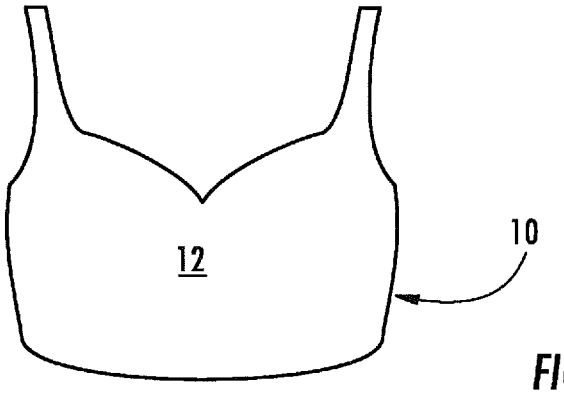
FIG. 5 is a front view of an alternative arrangement of bra top according to the present invention, showing a v-neckline and thin straps.
Figure 6:
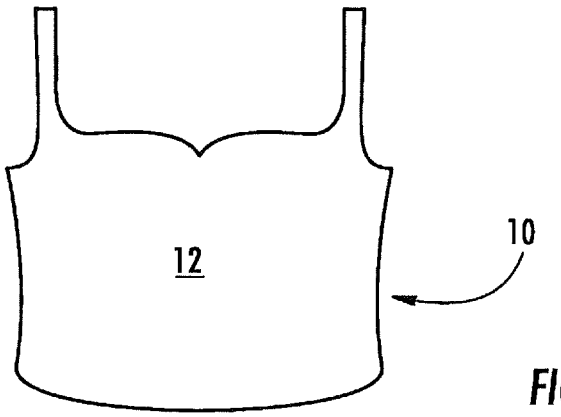
FIG. 6 is a front view of an alternative arrangement of bra top according to the present invention, showing a scalloped neckline and thin straps.

Referring to the figures, a bra top or half tank top 10 comprises a front portion 12 and a back portion 14. The portions 12, 14 may be cut in a wide variety of styles. For example, the front and back portions may have matching rounded (scooped) necklines, or may have one or two square (see FIG. 4), v-neck (see FIG. 5), sweetheart, scalloped (see FIG. 6), boatneck, high necklines or any other neckline that is desired, such as a Johnny collar, mandarin collar or the like, which are designed to give the impression that the wearer is wearing a complete garment under their outer clothing instead of just hiding their cleavage. The front and back portions may have the same or different necklines, and may have necklines of different heights. For example, the back portion may have a racer back style. The bra top 10 may have two, one or no shoulder straps. The shoulder straps may be relatively thick so as to easily conceal a wearer's bra straps, or may be relatively thin, such as a spaghetti strap. The shoulder straps may be extended to form cap sleeves or even to form short, ¾ length or long sleeves, depending on the particular design desired.

The bra top 10 has a lower edge 16 that is designed to sit around the wearer's ribcage in use, and is generally asymmetrical. The lower edge 16 is formed from a combination of a convex edge 18 on the front portion 12, and a concave edge 20 on the back portion 14. The lower edge 20 on the back portion 14 may be straight or relatively straight instead of concave. The convex edge 18 allows for the body of the bra top 10, particularly at the front, to extend over a wearer's breasts without the lower edge 16 riding up uncomfortably. In some arrangements, the lower convex edge 18 extends 1-2 inches lower than the concave edge 20 of the back portion, measured when the bra top 10 is placed on a flat surface. In more preferred arrangements, the convex front edge 18 can extend 1.5 inches lower than the concave rear edge in a medium size (having a fabric width of approximately 14.25 inches). It will be appreciated that different sizes of the bra top 10 can have a different degree of difference between the two lower edges, and that a bra top 10 designed for a plus-sized woman will have a greater difference in length of the front and back of the garment than a bra top 10 designed for a petite woman. In some arrangements, the difference in height between the front and back lower edges of the garments may be approximately equal to 10%-11% of the width of the garment when measured on a flat surface, such as 10.5%. The convex edge 18 to the bra top 10 enables the bra top 10 to be made without any seams, cups, darts or any other features on the body of the top that can provide an uneven appearance to clothing that is worn over the bra top 10, or that could otherwise bunch up. The only seams 22 in the top 10 are typically around the edges of the bra top 10, such as at the neckline, arm openings, and the lower edges. Alternatively, the bra top 10 may be knitted as a unitary garment without seams.

The lower edge 16 of the bra top is not elasticized or otherwise tightened in addition to the elasticity already provided by the fabric forming the bra top 10. This enables the bra top 10 to be generally worn over a wearer's regular bra, without any additional elastic band causing any discomfort around the wearer's ribcage. Alternatively, the bra top 10 can be worn without a bra underneath for greater comfort, or underneath a bra if the wearer wishes to use the bra top 10 to cushion the bra straps and to prevent them from chafing or digging in to the skin. As a further alternative, the bra top 10 can be worn over other clothing, so that the wearer can alter the appearance of an outfit as desired.

The fabric that is used to make the bra top 10 is designed to be elastic enough so that it is comfortable to wear, with just enough "cling" to stay in place but without constricting the breasts, reducing their apparent size or restricting movement. The fabric can be a mixture of a natural fiber, such as cotton, bamboo, silk, rayon, hemp, linen and the like, and a stretchable synthetic fiber such as spandex (for example, Lycra® or other brands), or any other similar fiber. The fabric can include recycled fibers. In a preferred arrangement, the fabric contains at least 80% natural fiber, and 20% or less synthetic fiber, with the high percentage of natural fiber contributing to the breathability of the garment. In more preferred arrangements, there is at least 90% natural fiber and 10% or less synthetic fiber. In further preferred arrangements, the fabric can contain 90-95% natural fiber, and 5-10% synthetic fiber. Typically, a large percentage (such as 90% or greater) of natural fibers means that a bra top is not highly compressive and is also not as supportive as sports bras designed to be worn alone. However, the greater the percentage of natural fibers that are used, the better the breathability of the garment, and the more comfortable it is to wear. Thus, the bra top 10 typically is constructed with a greater percentage of natural fibers than a sports bra, and is designed to be worn together with a bra. However, by providing a small percentage (5-10% or even up to 20%) of stretchable synthetic fibers, the bra top 10 is provided with enough elasticity for the garment to securely stay in place.

The bra top 10 is preferably knitted with a relatively dense knit so that the bra top 10 is opaque even when stretched. The fabric is preferably a jersey knit that will provide some stretchability and give to the finished article. The dense knit also provides more firmness to the material so that it will stay in place easily, and will not roll up uncomfortably with movement. The dense knit allows a wearer to adjust the height of the neckline as desired, and then to leave the bra top 10 in place, without worrying that the bra top will move during wear.

The bra top 10 can be provided in neutral colors, such as black, brown, beige, pink, cream, white and grey, that can blend in with and be worn interchangeably with a large number of other garments. Alternatively, the bra top 10 can be formed of fabric in bright or metallic colors, or can have patterns thereon to draw the eye or to provide an area of bright or contrasting color to a woman's outfit or to dress up an outfit. As another alternative, the whole of the bra top 10 or just the area that covers the cleavage and is designed to be seen can be provided with decoration, such as lace, metallic accents, sequins, beading, and the like. In the case of a lace or other decorative material, the bra top 10 can be formed in two or more layers, so that an underlayer can be seen through a lace overlayer for a decorative effect. The underlayer can, for example, be a mesh fabric so that the bra top 10 is slightly see-through.

As previously indicated, the bra top 10 provides advantages to the wearer, which include the ability to cover as much cleavage as she wants, the ability to wear outer garments that would otherwise be undesirable or inappropriate because they are too revealing, the comfort of not having to wear two full garments, such as a full tank top or camisole and an outer top, that may wrinkle or bunch due to fabric interactions, and the comfort of not having to wear two full garments in warm weather conditions. The wearer also does not need to continuously readjust a tank top or camisole to smooth out wrinkles or bunching under other garments, and is thus more comfortable while wearing the bra top 10. Also, there is no added material around the wearer's waist which might add bulk to the wearer's waist area and make her appear to be larger than she actually is. Additionally, the bra top 10 is useful during pregnancy to enable the wearer cover her cleavage without interfering with high cut maternity pants or skirts, and without needing to use camisoles or tank tops that are specifically designed for maternity wear or causing uncomfortable warmth to the wearer. Furthermore, unlike other cleavage covering devices, there are no snaps, tapes or ties that must be connected to a wearer's bra, and thus the bra top 10 is easy and comfortable to wear.

It should be understood that the examples and arrangements described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A bra top comprising:

a front portion having a generally convex lower border, and a neckline;

a back portion attached to or integral with the front portion and having a generally concave lower border; and wherein the convex lower border of the front portion extends lower than the concave lower border of the back portion such that additional material is available in the front portion to cover a wearer's breasts such that the lower border of the front portion and the lower border of the back portion are generally level around a wearer's ribcage when the bra top is worn, wherein at least the portion of the bra top that covers the wearer's cleavage is seen when the bra top is worn, wherein the bra top is worn between a wearer's regular bra and an outer garment, and wherein the bra top is comprised of a knit material having elasticity to stay in place when worn without constricting the wearer.

2. The bra top of claim 1, wherein the bra top is comprised of a combination of natural fibers and stretchable synthetic fibers or fiber blends.

3. The bra top of claim 2, wherein the natural fibers are selected from the group consisting of cotton, bamboo, silk, rayon, hemp, and linen.

4. The bra top of claim 2, wherein the synthetic fibers are spandex.

5. The bra top of claim 1, wherein the convex lower border of the front portion extends 1-3 inches lower than the concave lower border of the back portion at the point of maximum distance between the convex and concave lower borders.

6. The bra top of claim 5, wherein the convex lower border of the front portion extends 1-2 inches lower than the concave lower border of the back portion at the point of maximum distance between the convex and concave lower borders.

7. The bra top of claim 6, wherein the convex lower border of the front portion extends 1.5 inches lower than the concave lower border of the back portion at the point of maximum distance between the convex and concave lower borders.

8. The bra top of claim 1, wherein the convex lower border of the front portion extends lower than the concave lower border of the back portion at the point of maximum distance between the convex and concave lower borders by an amount equal to approximately 10-11% of a width of the lower border of the bra top.

9. The bra top of claim 1, wherein no cups, seams or darts are present in the body of the front portion.

10. The bra top of claim 2, wherein the lower borders of the front and back portions do not include elastic additional to the stretchable synthetic fibers present in the knit material.

11. The bra top of claim 1, further comprising at least one shoulder strap, wherein the at least one shoulder strap is designed to conceal the wearer's bra straps.

12. The bra top of claim 1, further comprising at least one shoulder strap, wherein the at least one shoulder strap is a thin strap or a spaghetti strap.

13. The bra top of claim 1, further comprising at least one shoulder strap, wherein the at least one shoulder strap is extended to form a sleeve.

14. The bra top of claim 13, wherein the sleeve is selected from the group consisting of a cap sleeve, a short sleeve, a ¾length sleeve and a long sleeve.

15. The bra top of claim 1, wherein the bra top comprises two shoulder straps.

16. The bra top of claim 1, wherein the back portion has a racer back style.

17. The bra top of claim 1, wherein the neckline is a front neckline selected from the group consisting of a rounded neckline, a square neckline, a v-neck neckline, a sweetheart neckline, a scalloped neckline, and a boatneck neckline.

18. The bra top of claim 17, further comprising a back neckline, wherein the back neckline is the same or different style as the front neckline.

19. A bra top comprising:

a front portion having a generally convex lower border;

a back portion attached to or integral with the front portion and having a generally concave lower border; and no shoulder straps;

wherein the convex lower border of the front portion extends lower than the concave lower border of the back portion such that additional material is available in the front portion to cover a wearer's breasts such that the lower border of the front portion and the lower border of the back portion are generally level around a wearer's ribcage when the bra top is worn, wherein at least the portion of the bra top that covers the wearer's cleavage is seen when the bra top is worn, wherein the bra top is worn between a wearer's regular bra and an outer garment, and wherein the bra top is comprised of a knit material having elasticity to stay in place when worn without constricting the wearer.

* * * * *